United States Patent [19]

Jaffrennou et al.

[11] 4,430,955

[45] Feb. 14, 1984

[54] FLEXIBLE FLOATING BOOM COMPRISING TRANSVERSE STIFFENERS OF VARIABLE STIFFNESS

[75] Inventors: Bernard Jaffrennou, Echirolles; Maurice Cessou, Communay, both of France

[73] Assignees: Institut Francais Du Petrole, Rueil-Malmaison; Société Rolba, Fontaine, both of France

[21] Appl. No.: 235,475

[22] Filed: Feb. 18, 1981

[30] Foreign Application Priority Data

Feb. 14, 1980 [FR] France ..... 80 03245

[51] Int. Cl.[3] ..... E02B 15/04

[52] U.S. Cl. ..... 114/267; 405/63; 405/72

[58] Field of Search ..... 114/121, 122, 123, 126, 114/140, 264-267; 441/44-49, 28, 30, 1, 136; 405/60-72

[56] References Cited

U.S. PATENT DOCUMENTS 3,922,862 12/1975 Vidilles ..... 405/70

3,973,406 8/1976 Casey ..... 405/70

4,116,007 9/1978 Stagemeyer et al. ..... 405/66

4,319,858 3/1982 Jaffrennou et al. ..... 405/66

FOREIGN PATENT DOCUMENTS 2378904 9/1978 France ..... 405/72

OTHER PUBLICATIONS

"Flexy Oil Boom", Hurum Shipping & Trading Company Ltd., Montreal, Canada, 1973.

*Primary Examiner*—S. D. Basinger
*Assistant Examiner*—Stephen P. Avila
*Attorney, Agent, or Firm*—Millen & White

[57] ABSTRACT

This floating boom comprises a flexible structure forming a barrier provided with transverse stiffeners to which are secured floats adapted to support this structure in a substantially vertical position in water. The stiffeners are designed so as to be resiliently bent at their lower part under the action of the water current for a velocity of the water current sufficient to cause bending without causing any substantial change in the inclination of the remainder of the boom in water.

23 Claims, 8 Drawing Figures

FLEXIBLE FLOATING BOOM COMPRISING TRANSVERSE STIFFENERS OF VARIABLE STIFFNESS

BACKGROUND OF THE INVENTION

The present invention relates to a flexible floating boom comprising transverse stiffeners of variable stiffness.

This boom is in particular suitable for defining shipping zones, or water areas which may be used for aquatic activities such as, for example swimming, or for aquaculture.

A very important application of the invention is for fighting against water pollution caused by floating solid wastes or by chemical products, more particularly hydrocarbons.

The boom according to the invention may be used in a stationary position, stretched between two mooring points, or as a net or trawl secured at its ends to one or several tug boats in order to clean a polluted water area.

A first type of already known floating boom comprises a cylindrical buoyant member to which is secured a skirt weighted by a chain at its lower end. Traction loads exerted on such a boom are applied to the weighting chain or to a cable secured to the boom. A drawback of this type of booms is that in a strong current the skirt is hollowed and water rises on the upstream side of the boom, thereby reducing the boom height above the water level. The polluting products then may flow over the cylindrical buoyant member. When the water current is very strong the boom may become entirely flooded, with water passing over the boom.

A second boom type comprises a flexible structure forming a barrier provided with transverse stiffeners to which are secured floats adapted to support this flexible structure in a substantially vertical position in water so as to form a screen. Such booms have the advantage of keeping a substantially constant height above the water level, but as the strength of water current increases they are tilted and may even turn upside down.

Steadiness of such a boom can be improved either by providing it with weighting means, but this has the drawback of increasing its inertia and consequently impairs its response to wave action. Alternatively, the steadiness can be improved by increasing the distance between the floats and the barrier plane, so as to increase the uprighting torque, with these floats being placed on a single side or on both sides of the barrier.

It is also known that above a certain value of the current speed (about 1 knot), the booms can no longer contain the polluting products which then flow under the boom as a result of a vortex effect (driving of the polluting layer under the boom in the form of small droplets which rise to the water surface downstream of the boom).

SUMMARY OF THE INVENTION

A first object of the invention is to provide a boom which can maintain a substantially constant height above water level with increasing current speed up to the upper limit-value of the current speed corresponding to the appearance of the above-discussed phenomenon of fluid leakage under the boom. This boom is moreover capable of keeping its vertical position without being destroyed or capsized for current speeds higher than the above-mentioned limit-value, so that this boom can fully recover its barrier function with respect to polluting products as soon as the current speed again becomes lower than said limit-value.

A second object of the invention is to provide a boom which can be easily stranded so that it can be used in tidal areas.

The above-mentioned booms of the type with a cylindrical buoyant member can be easily stranded, their skirt spreading over the ground when the cylindrical buoyant member is laid thereon.

However in this position the flexible skirt is covered with sand or pebbles due to the action of waves and undertow, which because of the combined action of the weight of the materials covering the skirt and of the suction effect of the latter on the ground induces important stresses at the connection between the cylindrical float and the skirt when the water level rises again, and such stresses may cause breaking or tearing.

The above-mentioned objects can be reached according to the invention by using a floating boom comprising a flexible structure forming a barrier provided with vertical stiffeners to which floats are secured, these floats being adapted to support the flexible structure in a substantially vertical position in the water, with said stiffeners being adapted to bend at their lower end leaving free space for passage of a current of sufficent velocity without causing any substantial change in the inclination of the remainder of the boom in the water.

According to a particular embodiment, said stiffeners are incurved at their lower part, in the absence of any force applied thereto, in a direction substantially perpendicular to the boom surface.

In this embodiment the boom will advantageously be provided with means supporting the flexible structure forming a barrier in a substantially vertical position when the boom is out of the water (on dry land, or stranded) in such a position that the incurved lower end of the stiffeners rests on the ground.

BRIEF DESCRIPTION OF THE DRAWINGS

Exemplative embodiments of the invention are illustrated by the accompanying drawings wherein.

DETAILED DISCUSSION OF THE INVENTION

Figure 1:
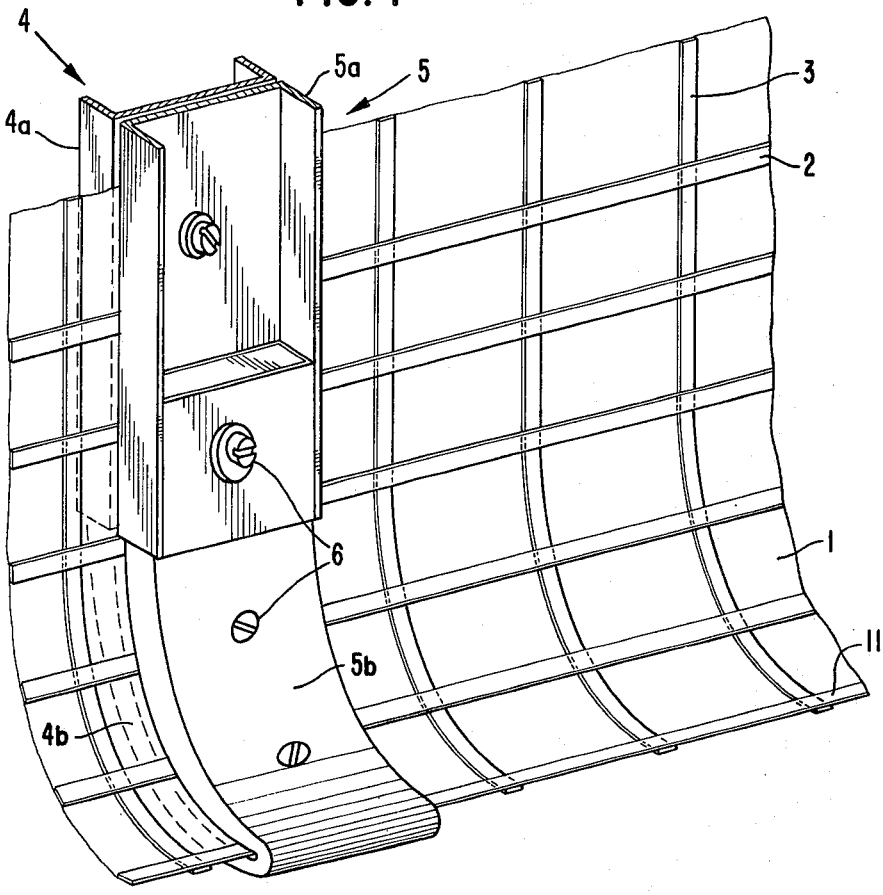
FIG. 1 is a diagrammatic perspective view of the flexible structure forming a barrier, and of the stiffeners of variable stiffness of a boom according to the invention, FIGS. 2A, 2B, 2C and 2D, diagrammatically illustrate a transverse cross-section of this boom at the location of a stiffener, at increasing speeds of the water current.

FIG. 1 shows in part a boom according to the invention comprising a flexible structure forming a barrier which includes a flexible skirt 1 and an armouring comprising longitudinal elements of a high tensile strength which may advantageously be constituted by strips 2 of a reinforced material and resistant transverse elements which maintain a predetermined spacing between the longitudinal elements, these transverse elements being, for example, constituted by strips 3 of the same nature as strips 2.

These strips may for example be constituted by a core of plastic material, with a reinforcement of high resistance wires, such as metal wires, glass fibers, carbon fibers, or fibers of a plastic materials such as those used in the textile industry (polyamide, polyester . . . etc . . . ).

The armouring can be formed by welding together the elements 2 and 3, or by weaving these elements.

The boom also comprises transverse stiffeners, each formed of two profiled elements 4 and 5 placed on both sides of the armouring which is pressed therebetween optionally together with the skirt 1, these elements being interconnected by bolts or rivets 6, or by any other tightening means.

The continuity of the traction resisting armouring is thus not interrupted at the location of the stiffeners which are thus protected against traction loads applied to the boom, these loads being supported by the sole armouring.

Floats 7 and 8 are connected to the profiled elements 4 and 5 by arms 9 and 10.

According to the invention the stiffeners are made up such that their stiffness progressively decreases at their lower part towards the lower edge 11 of the barrier, this lower end of the stiffeners being moreover resilient.

The profiled elements constituting the stiffeners may for example comprise a rigid upper part formed of elements **4*a* and 5*a* at the lower end of which are inserted lower flexible and resilient elements 4*b* and 5*b*** whose stiffness progressively decreases in a downward direction.

The elements **4*b* and 5*b*** will be preferably made of a resilient material such as polyurethane, polychloroprene, armoured plastic materials . . . etc . . . .

The thickness or the cross-sectional area of these elements **4*b* and 5*b*** will for example, progressively decrease in the direction of the lower edge of the boom, so as to obtain the desired stiffness variation.

Generally the elements **4*b* and 5*b*** will preferably be made of a resilient material capable of withstanding water and the polluting products which must be contained by the boom.

These different profiled elements pressing the armouring and the skirt between each other may be for example, connected by rivets made of nylon, stainless steel or galvanized steel, in order to prevent water corrosion.

It will also be possible to connect these elements by sticking or welding.

Figure 2B:
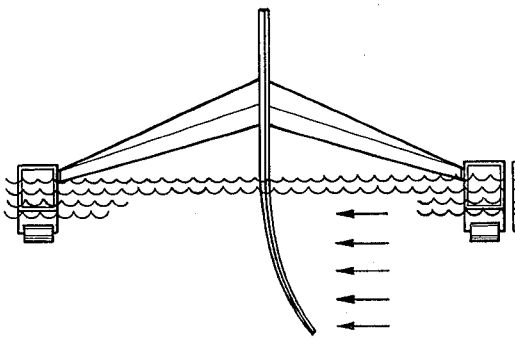
Figure 2A:
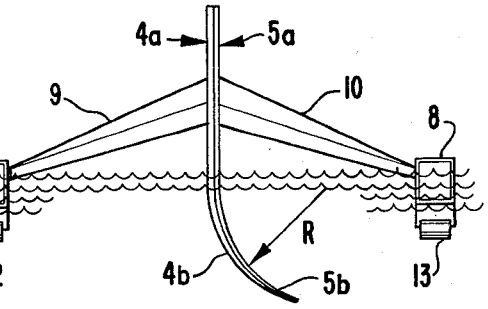

According to a preferred embodiment, the stiffening elements **4*b* and 5*b* will be pre-curved at rest, in the absence of forces applied thereto in a direction substantially perpendicular to the surface of the flexible structure forming a barrier. FIG. 2A** diagrammatically shows such bending with the radius of curvature R at rest.

Figure 2C:
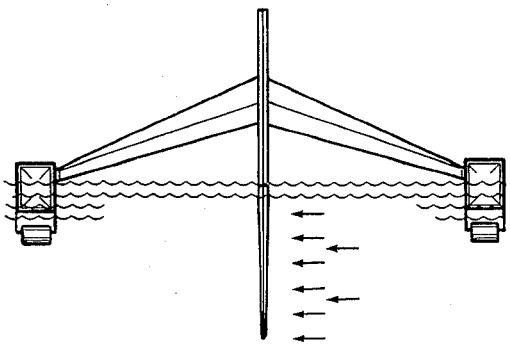
Figure 2D:
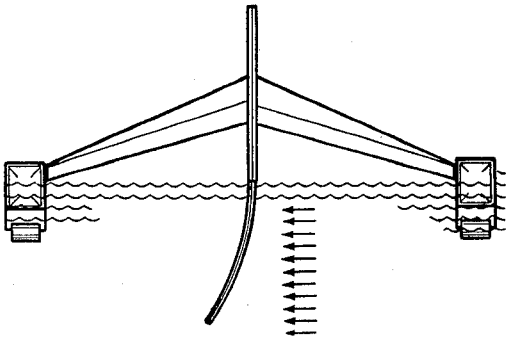

The use of stiffeners of variable stiffness enables a progressive deformation of the skirt as the forces due to the water current increase, as shown in FIGS. 2A, 2B, 2C and 2D, with the stiffening elements **4*b* and 5*b* progressively straightening themselves under the action of the current. The calculated stiffness of these elements may be such that the lower part of the stiffener becomes substantially vertical for the limit current velocity above which the boom can no longer act as a barrier with respect to the polluting products and is finally bent in the direction opposite to its initial bending shown in FIG. 2A when the water current velocity exceeds said limit value (FIG. 2D**). A valve effect is then obtained leaving passage to the water under the skirt when the current velocity exceeds said limit value, and this is achieved without damaging the boom or even substantially tilting it relative to a vertical line.

The boom thus keeps its screen action relative to the polluting products until the water current reaches the limit-value; it is not damaged for higher stream velocities at which in any event it can no longer contain the polluting products, and it recovers its capacity to retain them as soon as the current velocity again decreases below said limit-value, owing to the elasticity of the lower part of the stiffeners which then straighten themselves into one of the configurations shown in FIGS. 2A to 2C.

The space between the flexible elements **4*b* and 5*b* of the stiffener corresponds to the "neutral axis" thereof along which neither traction stresses, nor compression stresses are applied when this stiffener is bent (FIGS. 2A to 2D). Consequently there is no risk of the skirt 1 being torn during such a deformation when this skirt together with the armouring (2, 3) is pressed between the elements 4*a* and 4*b*, and 5*a* and 5*b***.

Figure 4:
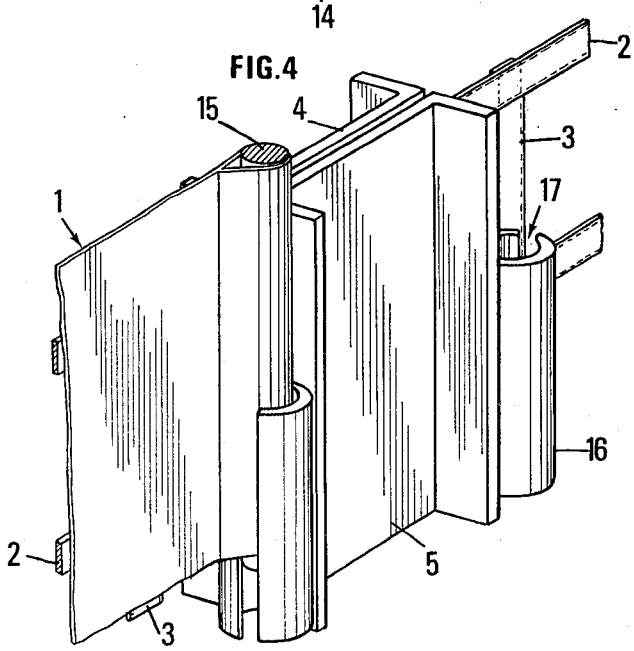
FIG. 4 illustrates an arrangement for securing skirt elements to the stiffeners.

However, in order to facilitate repairing of the skirt 1, it may be advantageous to form the latter of successive skirt elements each of which is provided at each end with a flexible rod 15 (FIG. 4) on which the skirt is folded so as to be welded to itself. This rod is inserted in locking means carried by the stiffeners, such as for example, the tube 16 which is welded to the element 5 and is provided with a longitudinal slot 17 forming a passageway for the skirt 1.

As regards the problem of stranding the boom, the use of stiffeners of variable stiffness can offer an interesting solution. As a matter of fact, if a curved shape is given to the lower part of these stiffeners at rest (radius of curvature R, FIG. 2A), this curved shape will be increased as the boom is stranded under the action of its own weight. By suitably adjusting through suitable means the height of the boom above the ground level, the radius of curvature r which the boom will then take will remain within acceptable limits.

Figure 3:
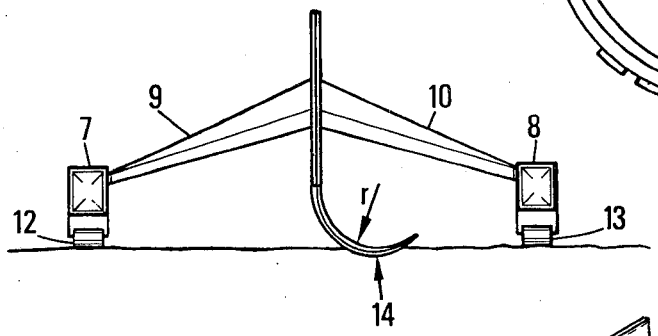
FIG. 3 is a diagrammatic transverse cross-section of a boom according to the invention which can be easily stranded.

Under these conditions (FIG. 3), the skirt will rest on the ground at its lower edge without lying completely flat thereon and this lower edge will be held in contact with the ground by the spring effect produced by the stiffener.

This will avoid any risk of the skirt being fully buried as in the case of the afore-mentioned prior art booms and due to this provision the boom will remain tight with respect to the polluting products during the entire low tide period, as well as during the beginning of the flow rise.

By way of non-limitative example, the stiffeners may be so designed that their radius of curvature at rest is comprised between 0.5 and 1 meter and so as to be straightened to a vertical position for water current velocities of 0.8 to 1 knot, so that the maximum draught of the boom is obtained for a current velocity close to the limit-velocity of containment of the polluting products. For the water current velocities higher than about 1 knot, the stiffeners will be progressively bent on their side opposite to the initial bending side (FIG. 2D). When the current velocity decreases, the stiffeners, made of a resilient material, recover their initial curved shape shown in FIG. 2A.

In order to improve the boom stability and behaviour when the boom is stranded, it is preferable, but not compulsory, to locate the floats on both sides of the boom (boom of the catamaran type) these floats being equipped with suitable means, such as skids, rollers or wheels 12 and 13, (FIG. 3), so as to rest on the ground in stranded position.

Figure 3A:
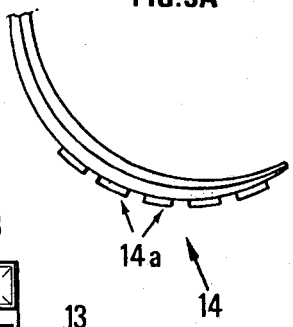
FIG. 3A is a detailed view of one embodiment of protecting means for the stiffeners.

Moreover, the wall of the stiffeners which comes into contact with the ground during the stranding step will advantageously be provided with protecting means 14 (plates, skids, rope), shown in FIG. 3A as plate 14A, to reduce the wear of these stiffeners on the ground.

The above-indicated arrangement will also facilitate the unfolding and putting in operation of the boom when the latter is set afloat.

When putting the boom in operation two cases may be considered:

(a) if damming a water stream, such as a river, is contemplated, the boom will advantageously be so positioned that the stiffeners have their concave side facing the upstream part of the river, (b) if the boom is used to protect a shore or an estuary subjected to tide and where the current has an alternating direction, the boom will preferably be so positioned that the stiffeners have their concave side facing the direction wherefrom the pollution originates (i.e. generally facing open sea).

What is claimed is:

1. A floating boom comprising a flexible structure made up of a longitudinally extending barrier having transverse stiffening means which extend throughout from the top to the bottom of said boom with float means attached thereto and adapted for supporting said flexible structure in a substantially vertical position in water, said stiffening means having in at least at the lower part thereof a stiffness progressively decreasing toward the lower edge of the boom, and said stiffening means being adapted for resiliently bending at the lower part when the boom is in use, in response to a water current of sufficient velocity to cause said bending, and adapted for simultaneously preventing any substantial change in the inclination of the remainder of the boom in the water.

2. A floating boom according to claim 1 wherein the thickness of the stiffening means progressively decreases toward the lower edge of the boom.

3. A floating boom according to claim 1 wherein the cross-sectional area of the stiffening means progressively decreases toward the lower edge of the boom.

4. A floating boom according to claim 1 wherein said stiffening means comprise a rigid upper part and a flexible and resilient lower part.

5. A floating boom according to claim 1, 2, 3 or 4, wherein said stiffening means are curved at their lower part, when at rest, in a transverse plane relative to the direction of elongation of the boom.

6. A floating boom according to claim 1, 2, 3 or 4, wherein the lower part of the stiffening means is made of polyurethane.

7. A floating boom according to claim 1, 2, 3 or 4, wherein the lower part of the stiffening means is made of polychloroprene.

8. A floating boom according to claim 1, 2, 3 or 4, wherein the lower part of the stiffening means is made of armoured plastic material.

9. A floating boom according to claim 5, further comprising means for supporting said flexible structure forming a barrier in a substantially vertical position when the boom is out of water so that said curved lower part of the stiffening means resiliently bears on the ground in said curved position.

10. A floating boom according to claim 9, wherein said support means comprises means for moving along the ground, equipped on the float means.

11. A boom according to claim 5, wherein said stiffening means comprise at their lower part abrasion resisting means, on the side of said stiffening means which is adapted to be in contact with the ground when the boom is out of water.

12. A boom according to claim 1, wherein said stiffening means comprises a plurality of stiffening means each separate and distinct from the others of said plurality.

13. A floating boom comprising a flexible structure made up of a barrier having transverse stiffening means with float means attached thereto and adapted for supporting said flexible structure in a substantially vertical position in water, said stiffening means having in at least at the lower part thereof a stiffness progressively decreasing toward the lower edge of the boom, with said stiffening means comprising a rigid upper part and a flexible and resilient lower part with the flexible and resilient lower part embedded in the lower end of said rigid upper part, and said stiffening means being adapted for resiliently bending at the lower part, when the boom is in use, in response to a water current of sufficient velocity to cause said bending and adapted for simultaneously preventing any substantial change in the inclination of the remainder of the boom in the water.

14. A floating boom comprising a flexible structure made up of a barrier having transverse stiffening means with float means attached thereto and adapted for supporting said flexible structure in a substantially vertical position in water, said stiffening means having in at least at the lower part thereof a stiffness progressively continuously decreasing in proportion downwardly toward the lower edge of the boom, and said stiffening means being adapted for resiliently bending at the lower part, when the boom is in use, in response to a water current of sufficient velocity to cause said bending, and adapted for simultaneously preventing any substantial change in the inclination of the remainder of the boom in the water, and wherein said flexible structure comprises a traction resistant flexible amouring with said stiffening means comprising a plurality of stiffeners, each comprising two elements located on both sides of the armouring with the armouring pressed therebetween.

15. A floating boom according to claim 14, wherein the flexible structure forming a barrier comprises a flexible skirt pressed between said elements forming each stiffener.

16. A floating boom according to claim 13, wherein said stiffening means are curved at their lower part, when at rest, in a transverse plane relative to the direction of elongation of the boom.

17. A floating boom according to claim 16 wherein the lower part of the stiffening means is made of polyurethane.

18. A floating boom according to claim 13, wherein the lower part of the stiffening means is made of polyurethane.

19. A floating boom according to claim 13, wherein the lower part of the stiffening means is made of polychloroprene.

20. A floating boom according to claim 13, wherein the lower part of the stiffening means is made of armoured plastic material.

21. A floating boom according to claim 16, further comprising means for supporting said flexible structure forming a barrier in a substantially vertical position when the boom is out of water so that said curved lower part of the stiffening means resiliently bears on the ground in said curved position.

22. A floating boom according to claim 21, wherein said support means comprises means for moving along the ground, equipped on the float means.

23. A boom according to claim 16, wherein said stiffening means comprise at their lower part abrasion resisting means, on the side of said stiffening means which is adapted to be in contact with the ground when the boom is out of water.

* * * * *